US010889419B2

(12) United States Patent
Lips

(10) Patent No.: US 10,889,419 B2
(45) Date of Patent: Jan. 12, 2021

(54) REMOVEABLE BAND WITH WINDOW FOR CONFINING STACKS OF DISPOSABLE CUTLERY

(71) Applicant: GPCP IP Holdings LLC, Atlanta, GA (US)

(72) Inventor: Erik Lips, Greenville, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/370,132

(22) Filed: Mar. 29, 2019

(65) Prior Publication Data

US 2020/0307883 A1 Oct. 1, 2020

(51) Int. Cl.

| | |
|---|---|
| ***B65D 71/02*** | (2006.01) |
| ***B65D 71/00*** | (2006.01) |
| ***B65D 75/02*** | (2006.01) |
| ***B65D 75/52*** | (2006.01) |

(52) U.S. Cl.

CPC ..... *B65D 71/02* (2013.01); *B65D 71/0085* (2013.01); *B65D 75/02* (2013.01); *B65D 75/522* (2013.01)

(58) Field of Classification Search

CPC .... B65D 71/02; B65D 71/0085; B65D 75/02; B65D 75/522

See application file for complete search history.

(56) References Cited

U.S. PATENT DOCUMENTS

| | | | | |
|---|---|---|---|---|
| 2,170,147 | A * | 8/1939 | Lane | B65D 73/02 206/447 |
| 4,524,512 | A | 6/1985 | Formo | |
| 5,785,354 | A * | 7/1998 | Haas | G04F 1/00 283/114 |
| 5,904,250 | A | 5/1999 | De Schutter | |
| 2007/0131741 | A1* | 6/2007 | Fransen | B65D 77/003 229/87.08 |
| 2009/0038123 | A1* | 2/2009 | Coronel | B65D 63/1009 24/306 |
| 2015/0237938 | A1* | 8/2015 | O'Neill | B60P 7/0823 2/322 |
| 2019/0125112 | A1* | 5/2019 | Mithal | A47F 1/06 |

FOREIGN PATENT DOCUMENTS

| | | | |
|---|---|---|---|
| WO | 2007049982 | A1 | 5/2007 |
| WO | 2010000096 | A1 | 1/2010 |
| WO | 2017176918 | A1 | 10/2017 |

OTHER PUBLICATIONS

International Search Report and Written Opinion mailed in International Application No. PCT/US2019/014173 dated Jul. 3, 2019.

* cited by examiner

*Primary Examiner* — Robert Sandy
*Assistant Examiner* — David M Upchurch

(57) ABSTRACT

A removeable band for confining a stack of cutlery pieces. The band can include a body having a first end and a second end. The body being an elongated strip of fiber-based material. A window can be formed through the body, and an adhesive can be disposed at least partially over the window. The adhesive can be configured to adhere a portion of the first end of the body to a portion of the second end of the body when the ends of the body overlap to form a continuous band.

20 Claims, 7 Drawing Sheets

REMOVEABLE BAND WITH WINDOW FOR CONFINING STACKS OF DISPOSABLE CUTLERY

BACKGROUND

Field

Embodiments described generally relate to disposable cutlery. More particularly, embodiments described relate to removable bands for retaining stacks of disposable cutlery.

Description of the Related Art

Disposable cutlery can be typically found in fast-food and take out restaurants as well as populated venues like sporting events, airports, train stations and the like. Cutlery dispensers have been used to provide a protective environment for the disposable cutlery housed within. Conventional cutlery dispensers, however, have challenges and issues delivering pieces of cutlery to a consumer in a repeatable and reliable manner Conventional cutlery dispensers typically suffer from one or more pieces of cutlery getting jammed within the dispenser and not able to be dispensed without time consuming attention and disassembly, which exposes the contents inside, i.e. the cutlery, to the surrounding environment. Conventional cutlery dispensers also have difficulties associated with re-loading cutlery and maintaining a reliable supply of cutlery for user demand.

Non-cartridge-type dispensers have used bands or other types of wrapping to contain a stack of cutlery during shipping and storage. Conventional methods for confining the plurality of cutlery are typically removed after the cutlery has been loaded into the dispenser. In order to do this, the band should be able to sufficiently store and hold the stack together prior to and during the loading/re-filling process as well as be able to be removed after the stack of cutlery is loaded in place without disturbing the stack within the dispenser. Conventional bands have not been able to reliably perform these functions.

There is a need, therefore, for an improved band to hold a stack of cutlery together during storage and transit, but at the same time capable of being removed from within a dispenser without disturbing the loaded stack.

SUMMARY

A removeable band for confining a stack of cutlery pieces is provided. In one embodiment, the band includes a body having a first end and a second end. The body can be an elongated strip of fiber-based material. A window can be formed through the body and an adhesive can be disposed at least partially over the window. The adhesive can be configured to adhere a portion of the first end of the body to a portion of the second end of the body when the ends of the body overlap to form a continuous band.

DETAILED DESCRIPTION

Figure 1:
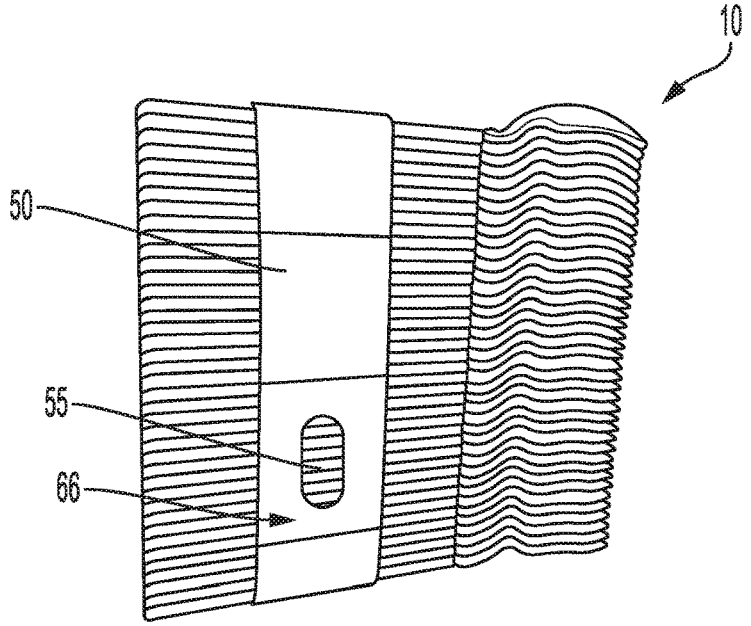
FIG. 1 depicts a perspective view of an illustrative stack of cutlery 10 held together by a band 50 that has an opening, according to one or more embodiments provided herein.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure can repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows can include embodiments in which the first and second features are formed in direct contact and can also include embodiments in which additional features can be formed interposing the first and second features, such that the first and second features cannot be in direct contact. The exemplary embodiments presented below also can be combined in any combination of ways, i.e., any element from one exemplary embodiment can be used in any other exemplary embodiment, without departing from the scope of the disclosure. The figures are not necessarily to scale and certain features and certain views of the figures can be shown exaggerated in scale or in schematic for clarity and/or conciseness Additionally, certain terms are used throughout the following description and claims to refer to particular components. As one skilled in the art will appreciate, various entities can refer to the same component by different names, and as such, the naming convention for the elements described herein is not intended to limit the scope of the invention, unless otherwise specifically defined herein. Further, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

All numerical values in this disclosure can be exact or approximate values ("about") unless otherwise specifically stated. Accordingly, various embodiments of the disclosure can deviate from the numbers, values, and ranges disclosed herein without departing from the intended scope.

The term "or" is intended to encompass both exclusive and inclusive cases, i.e., "A or B" is intended to be synonymous with "at least one of A and B," unless otherwise expressly specified herein.

The indefinite articles "a" and "an" refer to both singular forms (i.e., "one") and plural referents (i.e., one or more) unless the context clearly dictates otherwise.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same can be equally effective at various angles or orientations.

The term "disposable cutlery" means any cutlery intended for a single use although the cutlery can be used more than once, as desired by the end user. The term "disposable cutlery" does not include or relate to non-disposable cutlery, which is commonly referred to as "flatware" or "silverware". Suitable disposable cutlery can include or be made entirely from one or more polymeric materials, such as polystyrene, polyethylene or polypropylene, as well as blends and copolymers thereof. Such suitable disposable cutlery can include one or more fillers, as would be known to one of ordinary skill in the art. Methods for making suitable disposable cutlery is described in, for example, U.S. Patent Publication No. 2003/0015824, the entirety of which is incorporated herein by reference.

Unless the context clearly indicates otherwise, the terms "cutlery" and "utensil" are used interchangeably herein to refer to a fork, knife, spoon (including a soup spoon), spork or other types of apparatus.

FIG. 1 depicts a perspective view of an illustrative stack of banded cutlery 10, according to one or more embodiments. The cutlery pieces of the stack 10 can be held together by a band 50 having a window or opening 55 formed therethrough. The opening 55 can be formed anywhere along the length of the band 50. The opening 55 also can have any suitable size and/or shape. For example, the opening 55 can be oval, elliptical, circular, square, rectangular or any other polygonal shape. Any number of openings 55 can be used. When more than one opening 55 is used, the openings 55 can be randomly arranged about the band or equally spaced in the vertical direction, horizontal direction, or both, relative to an axial centerline of the band 50.

Figure 2A:
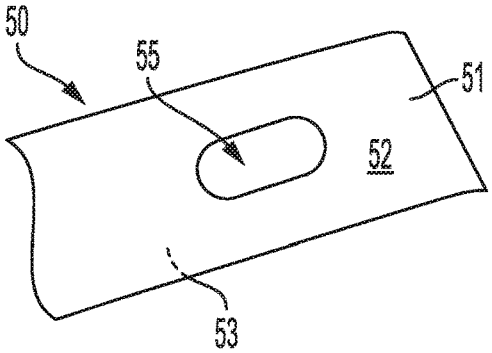
FIG. 2A depicts an enlarged schematic view of the band 50 and its formed therethrough, according to one or more embodiments provided herein.
Figure 2B:
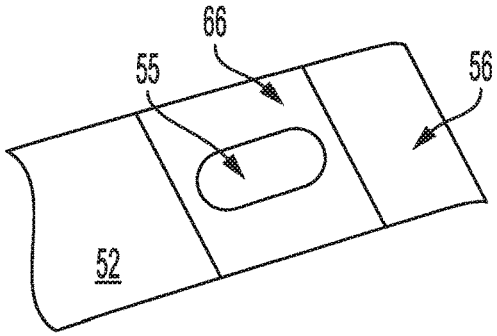
FIG. 2B depicts an enlarged schematic view of the band 50 showing a location of an adhesive section covering the opening in the band, according to one or more embodiments provided herein.

FIGS. 2A and 2B depict an enlarged schematic view of the band 50 having the opening 55 formed through one end or section of the band 50. As shown, the band 50 can include a body 51 having a first side or first surface 52 and a second side or second surface 53 that oppose one another. Referring to FIG. 2B, an adhesive or other form of attachment 66 can be disposed over at least a portion of the opening 55 to hold two ends of the band together, forming a continuous loop around the cutlery pieces, as depicted in FIG. 1. The adhesive section 66 can at least partially cover the opening 55 or the adhesive section 66 can completely cover the opening 55.

The adhesive section 66 can be or can include any suitable binder, adhesive or tape. The adhesive section 66 can be or can include one more adhesives or adhesive systems disposed thereon, including any suitable self-sealing, pressure sensitive or hot melt adhesive, which can be applied by spraying, brushing, flexographic printing, rotogravure printing, offset printing, screen printing, or any other suitable coating method. In one preferred embodiment, the adhesive section 66 is or includes a pressure sensitive tape.

A suitable adhesive can have a shear strength of about 10 N/cm to about 60 N/cm (as measured by TAPPI T494). The shear strength also can range from a low of about 10 N/cm, about 20 N/cm, or about 30 N/cm to a high of about 45 N/cm, about 55 N/cm, or about 60 N/cm. The shear strength also can range from a low of about 12 N/cm, about 18 N/cm, or about 25 N/cm to a high of about 30 N/cm, about 35 N/cm, or about 55 N/cm. The shear strength also can range from about 10 N/cm to about 30 N/cm; about 18 N/cm to about 30 N/cm; about 15 N/cm to about 35 N/cm; or about 20 N/cm to about 35 N/cm.

In one embodiment, a suitable adhesive can have a peel strength of 0.2 N/cm to about 1.0 N/cm (as measured according to ASTM D3330, Method A—180° peel test). The peel strength also can range from a low of about 0.2 N/cm, about 0.24 N/cm, or about 0.30 N/cm to a high of about 0.6 N/cm, about 0.75 N/cm, or about 1.0 N/cm. The peel strength, for example, can be about 0.33 N/cm to about 0.58 N/cm; about 0.35 N/cm to about 0.60 N/cm; or about 0.40 N/cm to about 0.53 N/cm. The peel strength also can be about 1.0 N/cm or less, about 0.9 N/cm or less, about 0.8 N/cm or less, about 0.7 N/cm or less, about 0.6 N/cm or less, about 0.5 N/cm or less, about 0.4 N/cm or less, about 0.3 N/cm or less, or about 0.2 N/cm.

Figure 3:
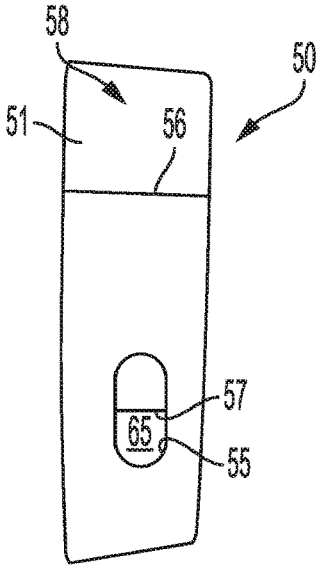
FIG. 3 depicts another illustrative schematic view of the band 50 showing its opening partially blocked by one of the tail ends, according to one or more embodiments provided herein.

FIG. 3 depicts an illustrative schematic view of the band 50 when formed into a loop, according to one or more embodiments provided herein. As shown, the band 50 can include a first end 56 (i.e. the "tab" side) and a second end 57 (i.e. the "tail-side") that can at least partially overlap to form a continuous loop. The degree of overlap (i.e. partial or complete) can dictate how much of the opening 55 is blocked by the underlying tail-side 57, as shown in FIG. 3 which depicts an "open window" configuration. In this embodiment, the opening 55 is not completely blocked or overlapped by the tail side 57 of the band 50. In this configuration, the opening 55 provides a path or passage 65 for the adhesive or any other form of attachment to form a bond directly with the other end of the band 50, or the cutlery pieces within the stack of cutlery 10, or both, as explained in more detail below with reference to FIGS. 4-8. In this open window configuration, the window 55 reduces the bonded surface area between the ends 56, 57 of the band 50, which allows the ends 56, 57 to be easily separated thereby breaking the loop and allowing the band 50 to be removed from the stack 10.

Figure 4:
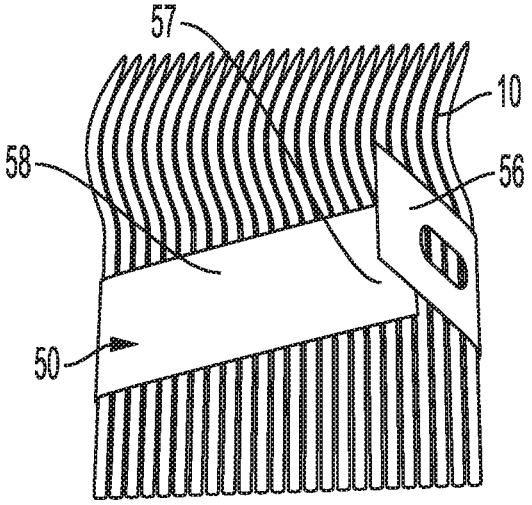
FIG. 4 depicts an illustrative view of the band 50 surrounding a stack of cutlery prior to securing the ends of the band together, according to one or more embodiments provided herein.

FIG. 4 depicts an illustrative view of the band 50 surrounding a stack of cutlery 10 prior to securing the ends 56, 57 of the band 50 together. The term "stack" refers to a configuration having multiple cutlery pieces aligned in a formation. The number of cutlery pieces in the stack 10 can vary. For example, the number of cutlery pieces in a stack can be about 2, 10, 20, 30, 40, 50, 60, 80, 100, 120, 150, 200 or more, where any of these numbers above can form an upper or lower endpoint. For example, the number of cutlery pieces in a stack 10 can be about 20 to about 100; about 40 to about 120; or about 30 to about 60. The type of cutlery can also vary. For example, the cutlery can be knives, forks, spoons, or sporks. Usually each piece of cutlery within a stack is the same, but it is conceivable to mix and match the types of cutlery in the same stack.

Figure 5A:
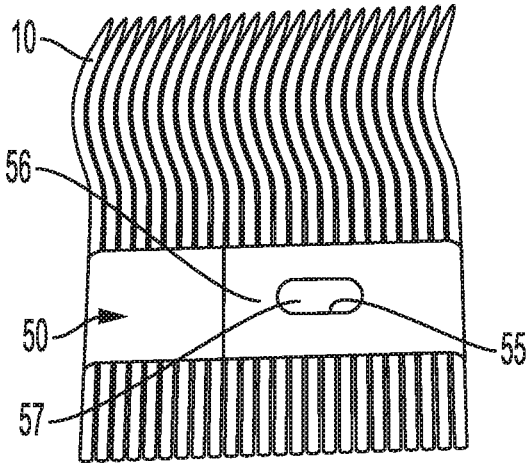
FIG. 5A depicts an illustrative view of the band 50 surrounding a stack of cutlery after securing the ends of the band together and providing a "closed" window configuration, according to one or more embodiments provided herein.

Considering the various band 50 configurations in more detail, FIG. 5A depicts an illustrative view of the band 50 surrounding the stack of cutlery 10 where the ends 56, 57 of the band 50 completely overlap such the window 55 is "closed" or blocked. In the closed window configuration, there is no adhesive contacting the cutlery pieces within the stack 10 when the adhesive 66 is applied over the window 55.

Figure 5B:
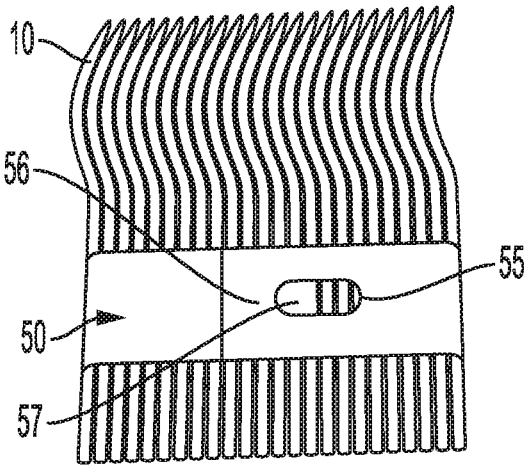
FIG. 5B depicts an illustrative view of the band 50 surrounding a stack of cutlery after securing the ends of the band together and providing an "open" window configuration, according to one or more embodiments provided herein.

FIG. 5B depicts an illustrative view of the band 50 surrounding the stack of cutlery 10 after overlapping and securing the ends 56, 57 of the band 50 together using an "open" or "at least partially open" window 55 configuration. By "open" and "at least partially open", it is meant that the window 55 is not closed such that when the adhesive 66 is applied, the two ends 56, 57 of the band can be adequately secured together forming the band 50 into a continuous loop while the adhesive makes contact and directly adheres to the stack. Contact of the adhesive to the stack, though the window 55, provides resistance to the band 50 from shifting about the stack of cutlery 20, such as during transport or storage. This resistance can be changed or adjusted by varying the size of the opening 55 or varying the length of the tail-side 57, or both. For example, the size of the passageway 65 can be changed or varied based on the amount of overlap of the ends 56, 57. For a given length of band 50, a shorter loop can be created by closing more of the passageway 65, and the converse is true whereby a larger loop can be created by opening more of the passageway 65. Not wishing to be bound by theory, it is believed that an open window 55 configuration significantly increases the ease in which the band 50 can be released and removed from the stack 10 after being loaded in a dispenser because of the reduced surface area of the tail portion 57 exposed through the window 55 of the band and bonded by the adhesive section 66. This reduced surface area provides a sufficient bond to hold the band 50 as a loop and minimizes delamination of the tail portion 57 when the tab portion 56 is pulled to release and remove the band 50—the less delamination, the cleaner the release.

By "end" of the band 50, it is meant the opposing extremities of the body 51 of the band 50. The term "end" is not meant to be limited to the most extreme boundary of the body 51 but is meant to refer to and include a portion of the body 51 that is adjacent or near the extreme boundary. This can include the last 1%, 5%, 10%, 20%, or 25% of the length of the body 51 as measured from the very end point of the body 51. The portion of the body 51 between its ends 56, 57 is the mid-section 58 of the body 51. The opening 55 can be entirely or only partially located in the mid-section 58 of the body 51. The opening 55 can be entirely or only partially located in one end 56 or 57 of the body 51.

In certain embodiments, the band 50 can include more than one opening 55. For example, the band 50 can include two, three, four, five, or six or more openings 55 disposed about the body 55, much like the holes on a belt. And as mentioned above, each opening 55 provides a passageway 65 for an adhesive or other form of attachment 66 to directly adhere to the tail-side 57 of the band 50, or directly to the stack of cutlery 10, or a portion of both.

Figure 6:
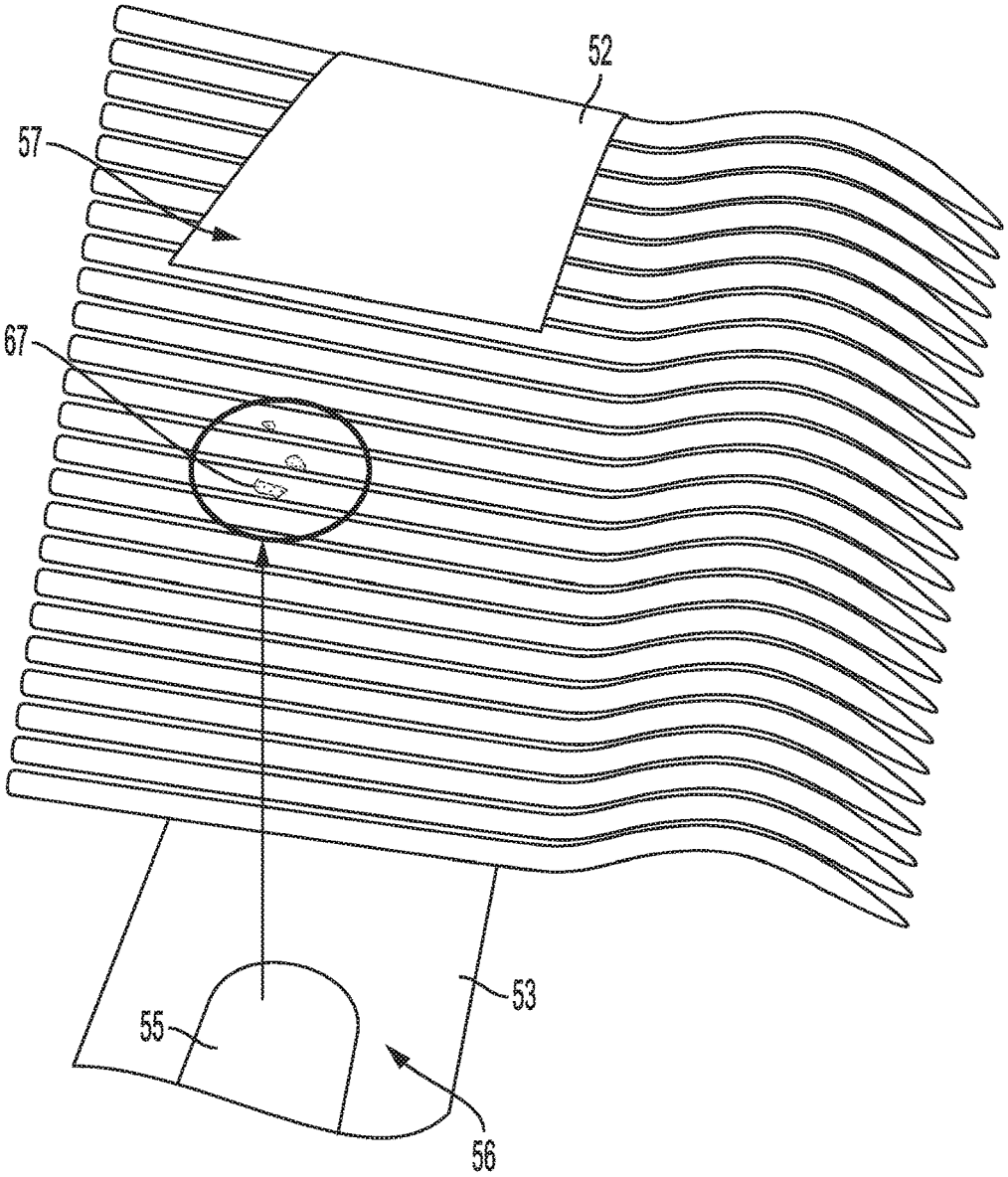
FIG. 6 depicts an illustrative view of the band 50 of FIG. 5B after the tab is separated from the tail showing adhesive residue left behind on the cutlery, according to one or more embodiments provided herein.

In the "open" window 55 configuration, a small amount of adhesive residue 67 may be left on the stack 10 as shown in FIG. 6. Because of the location of the band 20, any adhesive residue 67 left behind on the cutlery will be on the thickness dimension of the handle portion of a utensil. In other words, any adhesive residue 67 left behind does not contact the business end of the utensil and being on the thickness dimension of the handle is less likely to cause interference with its use. In certain embodiments, an adhesive selected for this use can have a peel and/or cohesive strength suitable for complete removal from the utensils.

Figure 7:
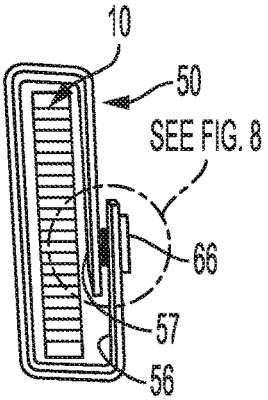
FIG. 7 depicts an illustrative end view of the band 50 around the stack of cutlery, according to one or more embodiments provided herein.
Figure 8:
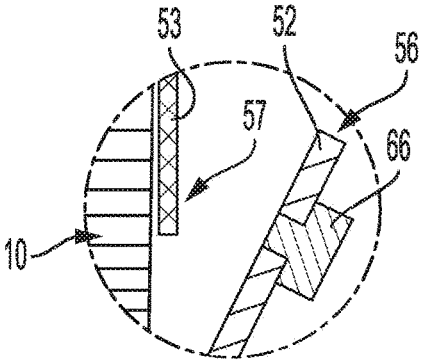
FIG. 8 depicts an enlarged section view of FIG. 7, according to one or more embodiments provided herein.

To further illustrate embodiments of the band 20, FIG. 7 depicts an illustrative end view of the banded stack of cutlery 20 and FIG. 8 depicts an enlarged section view of the band 50. Referring to FIGS. 7 and 8, the adhesive 66 can be seen extending through the window 55 to contact the tail-side 56 of the band 50 to secure the ends 56, 57 of the band 50 together.

Considering the body 51 of the band 50 in more detail, the body 51 can be an elongated strip of fiber-based material, polymeric material or combinations thereof. The body 51 can also be a combination of materials such that one region or section can be made from, for example, a fiber-based material and another region or section can be made from a polymeric material or a different kind of fiber-based material.

A suitable fiber-based material can be a paper-based material. In one form, the band 10 can be a strip of paper or paperboard. Commercially available paperboard material that may be used include, but is not limited to, solid bleached sulfate (SBS) board, bleached virgin board, unbleached virgin board, recycled bleached board, recycled unbleached board, or any combination thereof.

Each side 52, 53 of the body 51 can be uncoated or at least partially coated with one or more suitable coatings materials. Either side 52, 53 of the body 51 or both sides 52, 53 may be uncoated, e.g., free or substantially free from wax, clay, polymeric, or other coating material. Where applied, the coating can cover the entire area and/or length of the body 51 or only a portion thereof. For example, the coating can be applied at the very extreme end of the body 51 or about 45%, about 30%, about 20%, about 15%, about 10%, about 5%, or about 3% of the way from the end 57 to the mid-section 58 of the body 51. The same can be done on the other end 56.

The total thickness of the resulting monolayer and/or multilayer coating 30 can vary. The coating 30, for example, can have a thickness ranging from a low of about 0.002 mm, about 0.01 mm, or about 0.1 mm to a high of about 0.15 mm, about 0.2 mm, or about 0.35 mm.

The coating can be or can include one or more waxes, one or more clays, and/or one or more polymeric materials. The coating can be or can include, for example, polyethylene, polypropylene, polyester, polyethylene terephthalate, polyamide or any combination thereof. In a particular embodiment, the coating can be or includes polyethylene or polylactic acid ("PLA"). In another example, the coating can be or can include a butylene polymer, ethylene polymer, high density polyethylene (HDPE) polymer, medium density polyethylene (MDPE) polymer, low density polyethylene (LDPE) polymer, linear low density polyethylene (LLDPE), propylene (PP) polymer, isotactic polypropylene (iPP) polymer, high crystallinity polypropylene (HCPP) polymer, ethylene-propylene (EP) copolymers, ethylene-propylene-butylene (EPB) terpolymers, propylene-butylene (PB) copolymer, an ethylene elastomer, ethylene-based plastomer, propylene elastomer and combinations or blends thereof. In another example, the coating can be or can include polypropylene, polyvinylchloride (PVC), polymethylpentene, polybutene-1, polyolefin elastomers, polyisobutylene, ethylene propylene rubber, or any mixture or combination thereof.

The coating can be applied to the body 51 using any suitable process. For example, the coating can be applied by laminating, brushing, spraying, or extrusion. One or more coatings or layers of coatings can be applied. The one or more coatings can be applied on one or both sides 52, 53 of the body 51, or to any portion of one or both sides 52, 53. The number of layers of coatings can be different and can vary across the length of the body 51 and at various locations about the body 51.

Each band 50 can be about 0.05 inches to about 4 inches in width, or from about 1.0 inches to about 3.0 inches in width. The width is defined by the need to prepare a tight confinement of the plurality of cutlery and the need to readily remove the band after loading the stack inside a dispenser. It is possible that each band 50 will need to be smaller or larger to account for the specific shapes of the cutlery being bound and the number of cutlery pieces being stacked together. The overall size of each band 50 can be adjusted, as needed, by the amount of overlap at its ends 56, 57 to obtain a desired size of the loop.

In certain embodiments, a removeable tab can be formed within the band 50. The tab can be defined by a first set of one or more perforations formed in the body 51 and axially spaced from a second set of one or more perforations formed in the body 51 such that the perforations allow the tab to be separated and removed from the rest of the band 50, disconnecting the loop.

In additional embodiments, a second adhesive or second adhesive section can be used to secure the ends 56, 57 of the band 50. The second adhesive can be used in addition to or in lieu of the adhesive 66 in or over the opening 55. In certain embodiments, the second adhesive section can be located on one or both sides 52, 53 of the band 50, anywhere along the length of the body 51. The second adhesive section is preferably located away from the opening 55. The second adhesive section can be or can include one more adhesives or adhesive systems disposed thereon. Such adhesives or adhesive systems can be any suitable self-sealing, pressure sensitive or hot melt adhesive. The second adhesive can be applied by spraying, brushing, flexographic printing, rotogravure printing, offset printing, screen printing, or any other suitable coating method.

Referring again to FIG. 1, one or more bands 50 can be used to confine or otherwise hold the cutlery together, such as during transport and storage. The one or more bands 50 placed around the stack of cutlery 10 also facilitates the loading of the cutlery within a dispenser as will be explained in more detail below. Each band 50 can be located about a mid-section of the stack 10. For example, each band 50 can be located around the stack 10 between the functional end of the cutlery and the end of the handle, as depicted in FIG. 1. As such, the band(s) 50 does not cover either end of the cutlery pieces. As explained below, this configuration significantly simplifies the removal of the band(s) 50 after the cutlery stack 10 is loaded in a dispenser.

Figure 9:
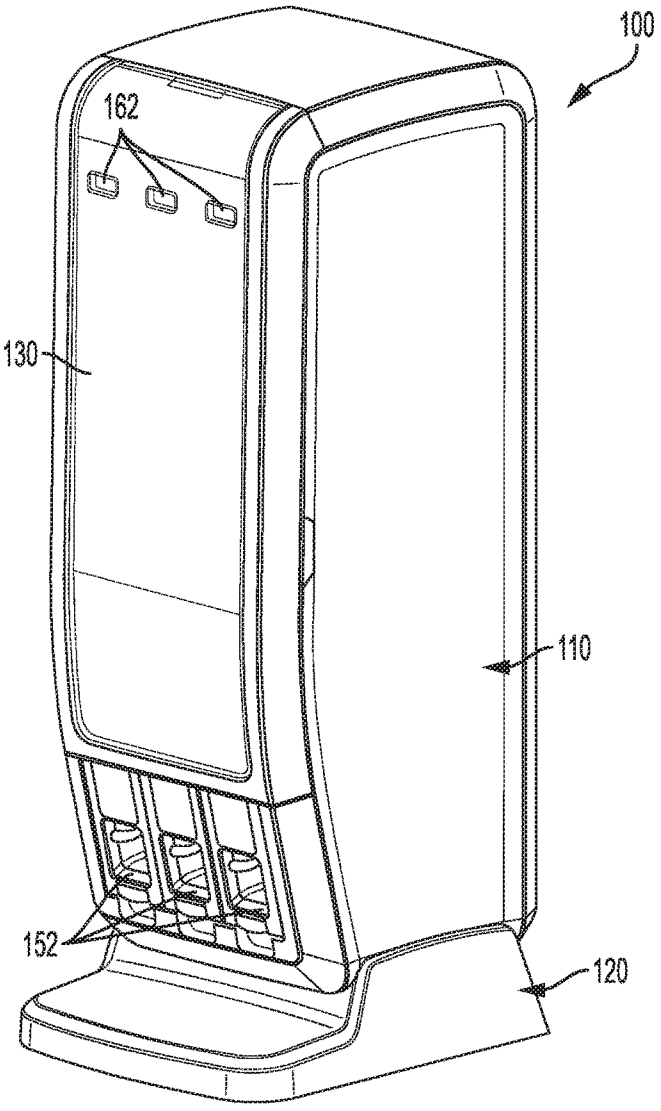
FIG. 9 depicts a perspective view of an illustrative cutlery dispenser, according to one or more embodiments provided herein.

FIG. 9 depicts a perspective view of an illustrative cutlery dispenser 100 suitable for use with the banded stack of cutlery 10, according to one or more embodiments. The cutlery dispenser 100 can include a housing or body 110 having a base 120 and an access door 130. The base 120 can provide support for the dispenser housing 110 and allows the cutlery dispenser 100 to be free standing. The base 120 can be fixedly attached to the bottom of the dispenser housing 110 using one or more fasteners such as screws, bolts, rivets, or any other type of fastener. The dispenser housing 110 can also sit on the base 120 without any form of mechanical fastening. The base 120 can be removable so that the cutlery dispenser 100 can be wall mounted using one more wall mounting attachment holes (not shown in these views).

The access door 130 can swing opened and closed using one or more hinges attached to the dispenser housing 110. The hinge locations can vary and can be located at the top, bottom, or side of the dispenser housing 110. The access door 130 can include one or more fill level apertures or windows 162 that align with corresponding fill level apertures or windows 172 disposed on the dispense chassis 150. As explained further below with reference to FIG. 11, these apertures or windows 162, 172 allow a visual indication of the stock of cutlery within the dispenser to be visible outside the dispenser 100.

Figure 10:
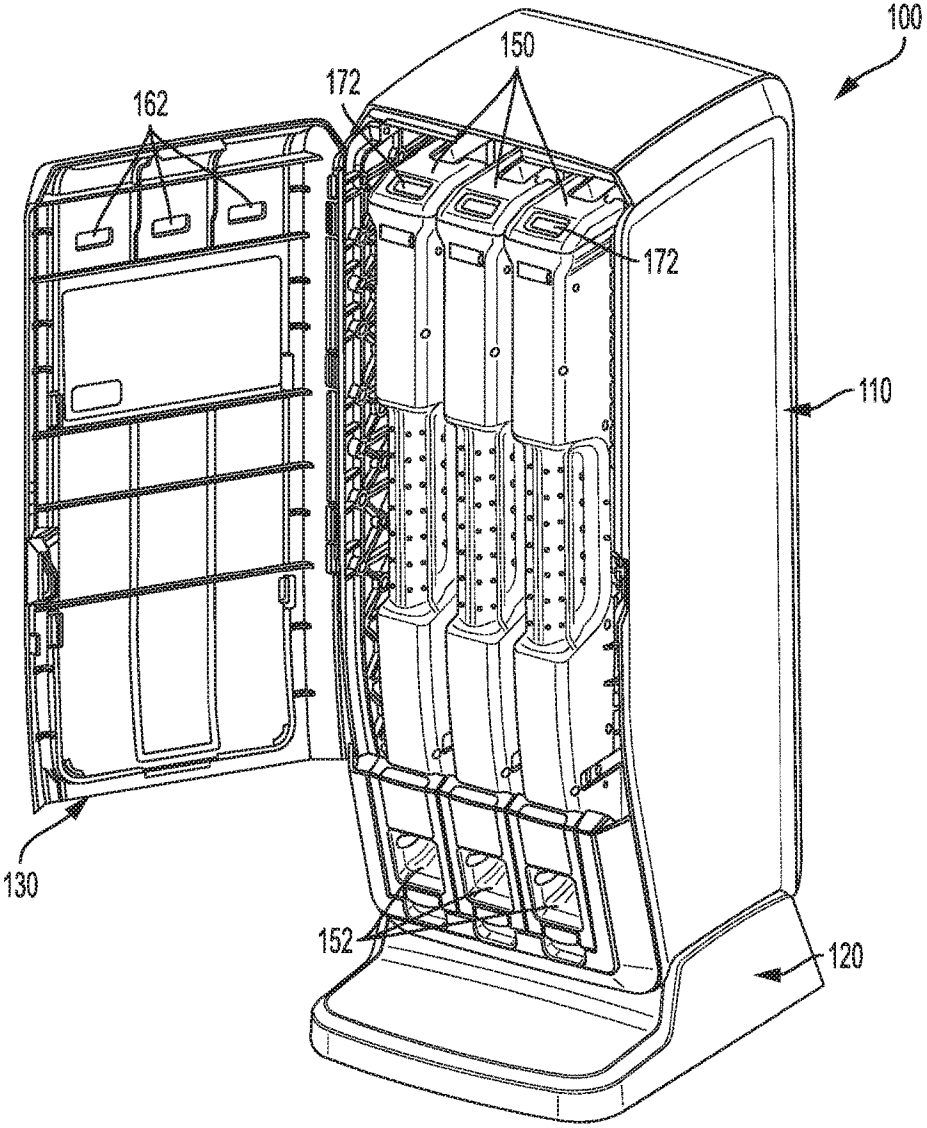
FIG. 10 depicts a perspective view of the illustrative cutlery dispenser of FIG. 9 with its access door open to reveal the dispense chassis located therein, according to one or more embodiments provided herein.

FIG. 10 depicts a perspective view of the illustrative cutlery dispenser of FIG. 9 with its access door 130 open to reveal one or more dispense chassis 150 located therein. Within the dispenser housing 110, the cutlery dispenser 100 can include one or more dispense chassis 150 for dispensing a plurality of cutlery through an access port 152 disposed at one end of each dispense chassis 150. Each dispense chassis 150 can be pre-packaged with cutlery (i.e. knife, fork, spoon, spork, etc.). In some implementations, the dispense chassis 150 is replaced with a new dispense chassis 150 and is not reused. In other implementations, the dispense chassis 150 can be refilled and reused in the cutlery dispenser 100.

Figure 11:
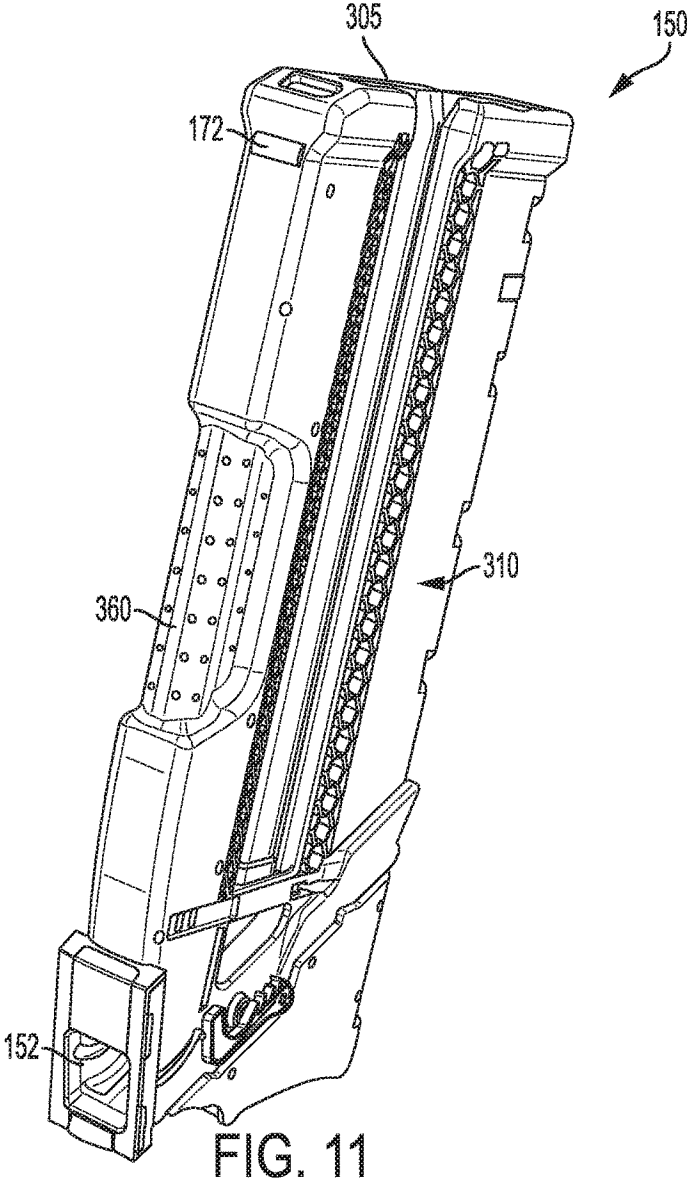
FIG. 11 depicts a side elevation view of an illustrative dispense chassis for use with the dispenser, according to one or more embodiments provided herein.

The cutlery dispenser 100 can accept any suitable number of dispense chassis 150. This particular dispenser 100 has room for up to three dispense chassis 150, as depicted. The cutlery dispenser 100 of FIG. 11 is shown with three dispense chassis 150, e.g., one for each of a spoon, fork, and knife, but any combination of cutlery can be used. Any of the dispense chassis 150 can be located within any dispensing position (e.g. left, right, middle for a 3 chassis dispenser) within the dispenser housing 110. Accordingly, a dispense chassis 150 of any type of cutlery can be placed into any available position.

FIG. 11 depicts a side elevation view of an illustrative dispense chassis 150 for use with the dispenser, according to one or more embodiments. The dispense chassis 150 can include a top 305 disposed on a first or upper end of a chassis body or chassis housing 310. The chassis housing 310 can further include a griper or handle 360 formed in a centrally located section or portion thereof. The handle 360 can provide a point of engagement for service personnel to more sanitarily carry or transport the dispense chassis 150 without having to touch the top 305 or access port 152 where the cutlery will be removed. The handle 360 will also allow a service personnel a point of contact to better manipulate the dispense chassis 150 when loading or loaded in the dispenser 100. Dispense chassis 150 can have one or more corresponding fill level windows 172 that allow a visual indication of the stock of cutlery in each respective dispense chassis 150, as explained below. In other embodiments, the fill level windows 172 can allow a line of sight into the chassis interior from the corresponding sight windows 162 on the access door 130 (FIG. 10).

Figure 12:
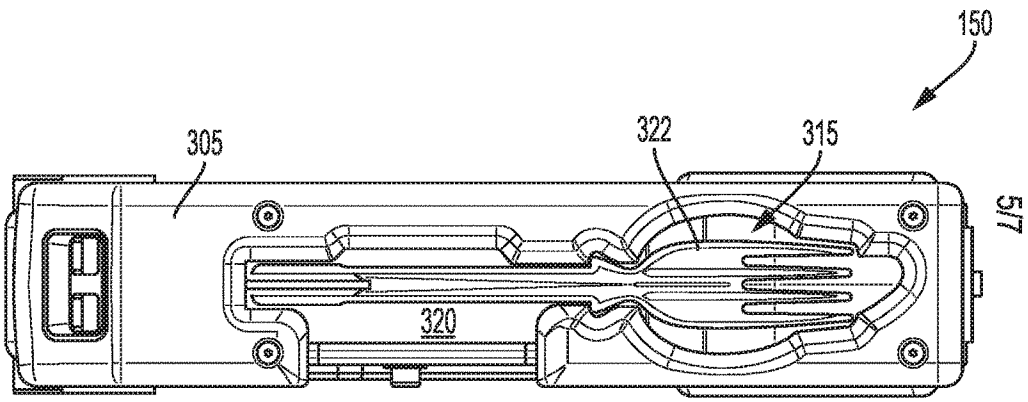
FIG. 12 depicts an illustrative top plan view of the dispense chassis depicted in FIG. 11, according to one or more embodiments provided herein.

FIG. 12 depicts an illustrative plan view of the dispense chassis 150 depicted in FIG. 11. As shown, the top 305 of the dispense chassis 150 can include an opening 315 to provide access to a cavity or chamber 320 within the chassis housing 310 for storing cutlery therein. The opening 315 can be universally configured or shaped to allow any type of cutlery 322 to pass through, including for example, a knife, fork (as shown), spoon and spork. Alternatively, each dispense chassis 150 can have a top opening 315 specific to one type of cutlery. In some embodiments, the top 305 can be snap fitted onto the chassis housing 310, so the top 305 can be easily removed or interchanged to customize the cutlery types for a particular dispense chassis 150.

Figure 13:
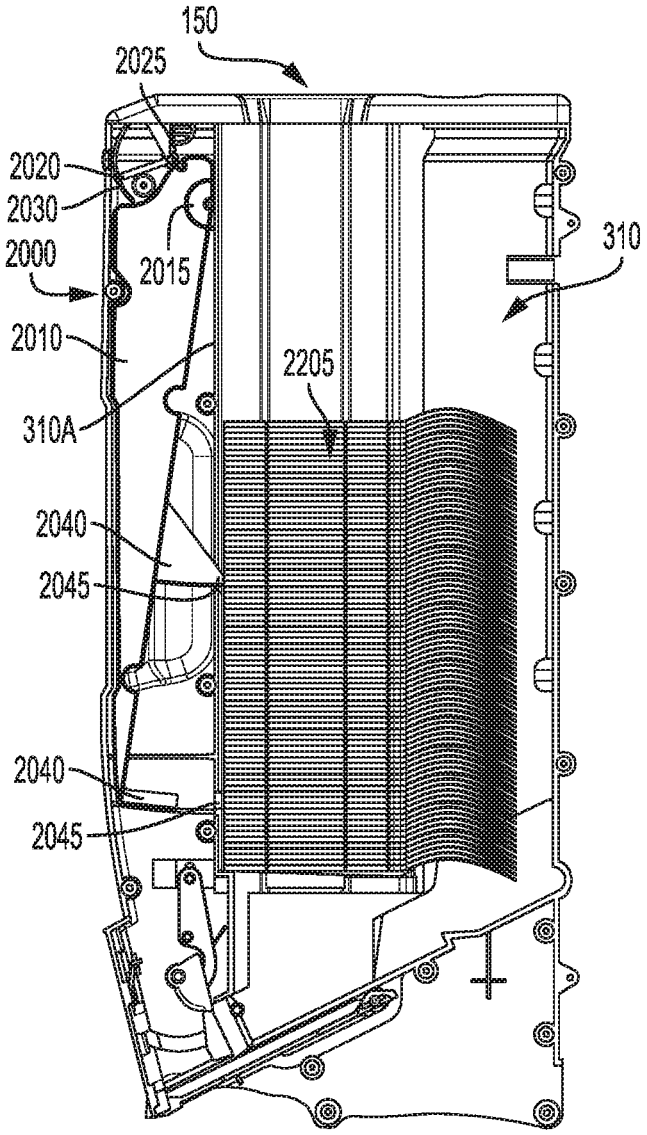
FIG. 13 depicts a cut away side view of the illustrative dispense chassis in which the chassis is loaded with cutlery, according to one or more embodiments provided herein.

Each dispense chassis 150 can be configured with a gauging device to help approximate the number of cutlery within the dispense chassis 150. FIG. 13 provides an illustrative cut away view of a dispense chassis 150 configured with a gauging assembly 2000, according to one or more embodiments. The gauging assembly 2000 can include a first gauge arm 2010 pivotally connected to the chassis housing 310 at pivot 2015, and a second gauge arm 2020 pivotally connected to the chassis housing 310 at pivot 2025. The second gauge arm 2020 can include an indicator 2030 at an external end thereof that can be seen through the apertures or windows 172 on the dispense chassis 150 and the apertures or windows 162 of the access door 130. The indicator 2030 provides a visual indication of the approximate number of cutlery in the stack 2205.

Movement of the first gauge arm 2010 about its pivot connection 2012 can be translated to movement of the second gauge arm 2020 about its pivot connection 2025 to move the indicator 2030 relative to the gauge window 172. In an alternative embodiment that is not shown, the first gauge arm 2010 and the second gauge arm 2020 can be fixed together and can pivot such that movement of the first gauge arm 2010 about the pivot 2012 can be translated into movement of the second gauge arm 2020 to move the indicator 2030 relative to the gauge window 172.

The indicator 2030 can display different quantities of cutlery within the stack 2205, the quantities being visible through the gauge window 172. The indicator 2030 can have different quantities printed on different parts of the indicator 2030. The different quantities can be visible through the gauge window 172 one at a time or multiple quantities can be displayed to show that the level is between the quantities displayed. For example, the indicator 2030 could have "Full" and/or a green color printed on the indicator 2030 that is visible through the gauge window 172 when the dispense chassis 150 has more than a certain amount of cutlery in the cutlery stack 2205, more than 50% full, more than 60% full, more than 70% full more than 80% full, or more than 90% full; "Half-Full" and/or a yellow color printed on the indicator portion that is visible through the gauge window 172 when the dispense chassis 150 has certain amounts of cutlery in the cutlery stack 2205, between 10% full and 90% full, between 20% full and 80% full, between 30% full and 70% full, between 40% full and 60% full; and/or "Empty" and/or a red color printed on the indicator 2030 that is visible through the gauge window 172 when the dispense chassis 150 has less than a certain amount of cutlery, such as less than 5, less than 4, less than 3, less than 2, or none in the stack 2205. Alternatively, the colors can be used to indicate how many full stacks of cutlery (the number of cutlery in a full stack of cutlery refills can vary) can be added to the dispense chassis 150. For example, where a full stack of cutlery refills is thirty, green can indicate that less than one full stack of cutlery refills will fit within the dispense chassis 150. Yellow can indicate that more than one full stack of cutlery refills can be added to the dispense chassis 150, and red can indicate that two full stacks of cutlery refills can be added to the dispense chassis 150.

The first gauge arm 2010 can include any number of extensions or prongs 2040 that are configured to contact a side of the stack 2205. For example, the first gauge arm 2020 can include 1 prong, 2 prongs, 3 prongs, 4 prongs, or 5 prongs disposed along its length. In one particular embodiment, the first gauge arm 2010 has two prongs as shown in FIG. 13. The prongs 2040 can be disposed on any suitable position along the length of the first gauge arm 2010. If more than two prongs 2040 are used, the spacing between prongs 2040 can be the same or can vary. Although not shown, each prong 2040 can be moveably attached to the first gauge arm 2010 using a clamp or pinch like fastener, so that a prong 2040 can be moved or adjusted along the length of the first gauge arm 2010 based on patterns of use.

The chassis housing 310 can include a gauge aperture or opening 2045 formed through an internal wall 310A through which the prong(s) 2040 can extend and contact a side of the stack 2205. The gauge aperture or opening 2045 can be a recessed section or cut away formed in the internal wall 310A, allowing an adjacent prong 2040 to pass through. Referring to the embodiment shown in FIG. 13, when the height of the cutlery stack 2205 is at or above the first or upper gauge opening 2045, the first or upper prong 2040 moves through the opening 2045 until it contacts the side of the stack 2205. This contact sets the first gauge arm 2010 at a first angle about its pivot 2015, which positions the second gauge arm 2020 at a first angle about its pivot 2025, which positions the indicator 2030 that is visible through the gauge window 172. The position of the indicator 2030 corresponds to a quantity of cutlery in the stack 2205 (i.e. the height of the stack 2205) within the chassis housing 310.

The gauge window 172 can have any suitable height, such as about 2 mm, 3 mm, 5 mm or more, and can display colors, numbers, percentages, or any other indicator to indicate the number of cutlery or stack height within the dispense chassis 150. The first gauge arm 2010 can swing with gravity and with or without a spring assistance. The weight and/or the center of gravity of the first gauge arm 2010 can be adjusted to change how the cutlery stack gauge 2000 operates. The position and/or the number of the prongs 2040 can be adjusted to provide more precise level indicators. Additionally, in an embodiment not shown, the first gauge arm 2010 can be located inside the housing wall 310A such that any one or more of the prongs 2040 can directly contact the cutlery stack 2205 without passing through an opening 2045.

Figure 14:
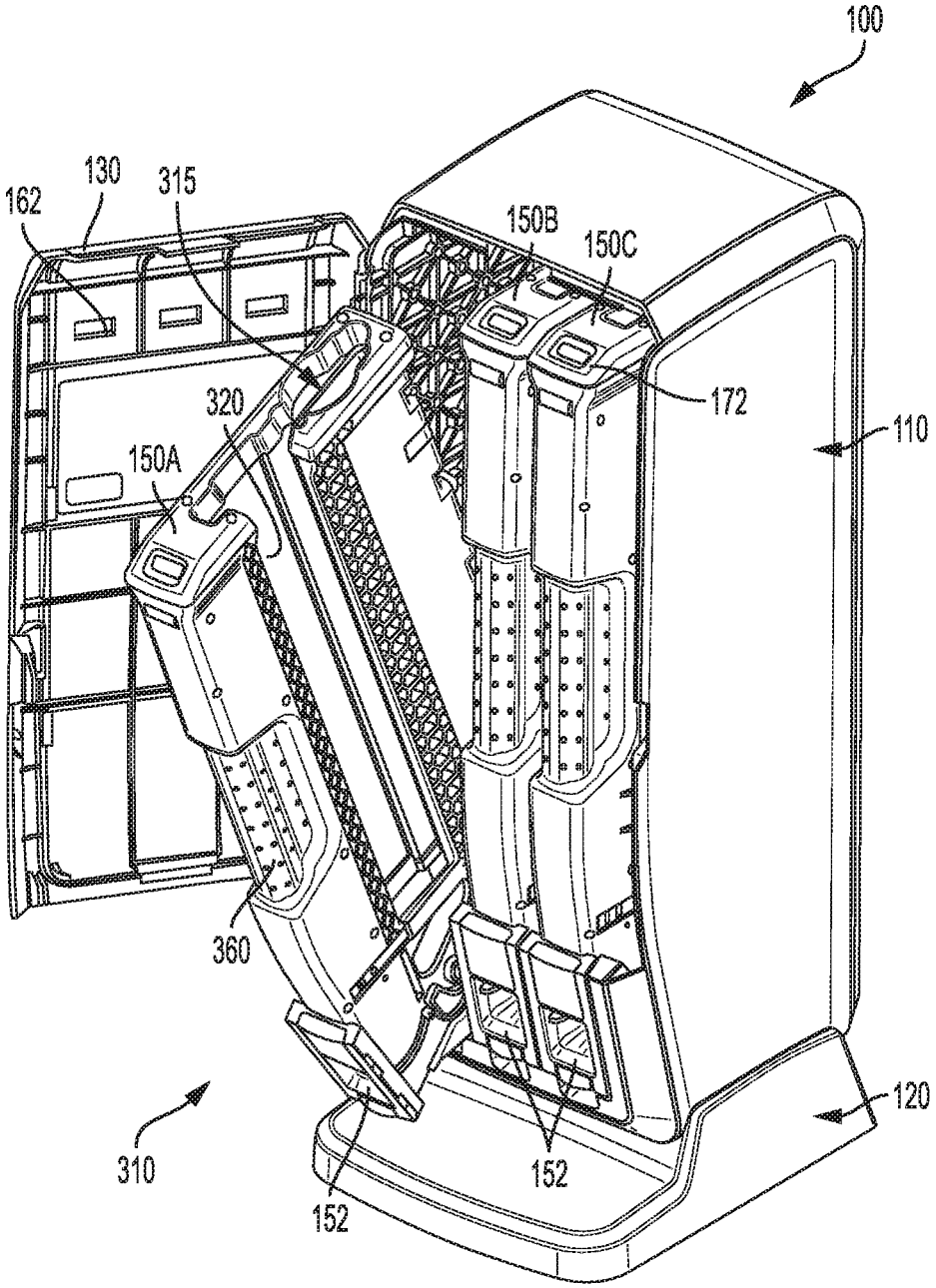
FIG. 14 depicts an illustrative perspective view of the cutlery dispenser having its access door open, allowing a dispense chassis to be loaded, according to one or more embodiments provided herein.

FIG. 14 depicts a perspective view of the illustrative cutlery dispenser 100 showing a first dispense chassis 150A in a loading position, and a second and third dispense chassis 150B, 150C in a dispensing position, according to one or more embodiments. When the dispense chassis 150A is in the loading position, the banded stack of cutlery 10 can be loaded into the first dispense chassis 150A through the loading opening 315. Once loaded, the band 20 can be easily accessed through the opening 320 and removed, leaving the stack of the cutlery within the chassis 150A. Any adhesive residue 67 left on the stack can be removed by hand or other means, or simply left on the stack. The same is true for the other dispense chassis 150B, 150C when time comes to re-load with cutlery. Utensils in any dispense chassis that is in the dispensing position 330 can be dispensed while any one of the other dispense chassis is in a loading position. Any dispense chassis 150 can be moved between a dispensing position and a loading position while remaining connected to the dispenser housing 110.

The present disclosure further relates to any one or more of the following numbered embodiments 1 to 20:

1. A removeable band for confining a stack of cutlery pieces, comprising: a body having a first end and a second end, the body being an elongated strip of fiber-based material; a window formed through the body; and an adhesive disposed at least partially over the window, the adhesive configured to adhere a portion of the first end to a portion of the second end when the ends of the body overlap to form a continuous band.

2. The removeable band according to embodiment 1, wherein the window formed through the body is at least partially obstructed by a portion of the body when the ends of the body overlap.

3. The removeable band according to embodiments 1 or 2, wherein the window formed through the body is not completely obstructed by the body when the ends of the body overlap.

4. The removeable band according to any one or more embodiments 1 or 2, wherein the adhesive adheres to at least one piece of cutlery.

5. The removeable band according to any one or more embodiments 1 to 4, wherein the adhesive is a pressure sensitive adhesive or a hot melt adhesive.

6. The removeable band according to any one or more embodiments 1 to 5, further comprising a coating disposed on at least one side of the body.

7. The removeable band according to embodiment 6, wherein the coating comprises one or more polyolefins.

8. The removeable band according to embodiments 6 or 7, wherein the coating comprises low density polyethylene.

9. The removeable band according to embodiment 6, wherein the coating comprises biaxially-oriented polypropylene.

10. The removeable band according to any one or more embodiments 1 to 9, wherein the fiber-based material is paper or paperboard.

11. The removeable band according to any one or more embodiments 1 to 10, wherein the body has a thickness of about 0.010 inches to about 0.012 inches.

12. A removeable band for confining a stack of cutlery pieces, comprising: a body having a first end and a second end, the body being an elongated strip of fiber-based material; a window formed through the body; and an adhesive section disposed at least partially over the window, the adhesive section configured to adhere a portion of the first end to a portion of the second end when the ends of the body only partially overlap to form a continuous band, leaving a passageway through the window.

13. The removeable band according to embodiment 12, wherein the adhesive is a pressure sensitive adhesive or a hot melt adhesive.

14. The removeable band according to embodiments 12 or 13, further comprising a coating disposed on at least one side of the body.

15. The removeable band according to embodiment 14, wherein the coating comprises one or more polyolefins.

16. The removeable band according to embodiment 14, wherein the coating comprises low density polyethylene or biaxially-oriented polypropylene.

17. The removeable band according to any one or more embodiments 12 to 16, wherein the fiber-based material is paper or paperboard.

18. A removeable band for confining a stack of cutlery pieces, comprising: a body having a first end and a second end, the body being an elongated strip of fiber-based material; a window formed through the body; a coating disposed on only one side of the second end of body; an adhesive section disposed at least partially over the window, the adhesive section configured to adhere a portion of the first end to a portion of the coated second end when the ends of the body only partially overlap to form a continuous band, leaving a passageway through the window.

19. The removeable band according to embodiment 18, wherein the coating comprises low density polyethylene or biaxially-oriented polypropylene.

20. The removeable band according to embodiments 18 or 19, wherein the fiber-based material is paper or paperboard.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A removeable band for confining a stack of cutlery pieces, comprising:

a body having a first end and a second end, the body being an elongated strip of fiber-based material;

an opening proximate the first end of the body; and an adhesive configured to adhere a first portion of the body to a second portion of the body to form a continuous band when the first end and the second end of the body at least partially overlap the other, wherein the opening is not obstructed by either end of the body when the ends of the body at least partially overlap.

2. The removeable band of claims 1, further comprising a coating disposed on at least one side of the body.

3. The removeable band of claim 2, wherein the coating comprises one or more polyolefins.

4. The removeable band of claim 2, wherein the coating comprises low density polyethylene.

5. The removeable band of claim 2, wherein the coating comprises biaxially-oriented polypropylene.

6. The removeable band of claim 2, wherein the coating is disposed on one side of one end of the body.

7. The removeable band of claims 1, wherein the fiber-based material is paper or paperboard.

8. The removeable band of claim 1, wherein the body has a thickness of about 0.010 inches to about 0.012 inches.

9. A removeable band for confining a stack of cutlery pieces, comprising:

a body having a first end and a second end, the body being an elongated strip of fiber-based material;

an opening proximate the first end of the body; and an adhesive section configured to adhere a first portion of the body to a second portion of the body to form a continuous band when the first end and the second end of the body at least partially overlap the other, wherein the opening is not obstructed by either end of the body when the ends of the body at least partially overlap.

10. The removeable band of claim 9, wherein the adhesive section comprises a pressure sensitive adhesive or a hot melt adhesive.

11. The removeable band of claim 9, further comprising a coating disposed on at least one side of the body.

12. The removeable band of claim 11, wherein the coating comprises one or more polyolefins.

13. The removeable band of claim 11, wherein the coating comprises low density polyethylene or biaxially-oriented polypropylene.

14. The removeable band of claim 11, wherein the coating is disposed on one side of one end of the body.

15. The removeable band of claim 9, wherein the fiber-based material is paper or paperboard.

16. A removeable band for confining a stack of cutlery pieces, comprising:

a body having a first end and a second end, the body being an elongated strip of fiber-based material;

an opening proximate the first end of the body; and;

an adhesive section disposed at least partially over the opening to adhere a first portion of the body to a second portion of the body to form a continuous band when the first end and the second end of the body at least partially overlap the other, wherein the first portion of the body or the second portion of the body extends above or below the opening after the continuous band is formed, thereby at least partially obstructing the opening with one of the first or second ends of the body.

17. The removeable band of claim 16, further comprising a coating disposed on one side of one end of the body.

18. The removeable band of claim 17, wherein the coating comprises low density polyethylene or biaxially-oriented polypropylene.

19. The removeable band of claim 18, wherein the fiber-based material is paper or paperboard.

20. The removeable band of claim 16, wherein the opening is completely obstructed by overlapping the first and second ends of the body.

* * * * *